US006882312B1

(12) United States Patent
Vorobiev et al.

(10) Patent No.: US 6,882,312 B1
(45) Date of Patent: Apr. 19, 2005

(54) METHOD AND APPARATUS FOR MULTIPATH MITIGATION USING ANTENNA ARRAY

(75) Inventors: Michael Yu. Vorobiev, Ljubertsy (RU); Mark I. Zhodzishsky, Moscow (RU); Andrew V. Veitsel, Moscow (RU); Victor A. Veitsel, Moscow (RU); Alexey V. Zhdanov, Moscow (RU); Sergey N. Pushkarev, Moscow (RU)

(73) Assignee: Topcon GPS, LLC, Paramus, NJ (US)

( * ) Notice: Subject to any disclaimer, the term of this patent is extended or adjusted under 35 U.S.C. 154(b) by 0 days.

(21) Appl. No.: 10/806,781

(22) Filed: Mar. 23, 2004

(51) Int. Cl.[7] ..... H01Q 3/02; H01Q 3/12

(52) U.S. Cl. ..... 342/374; 455/277.1

(58) Field of Search ..... 342/357.06, 357.12, 342/372, 374, 442; 701/207, 213; 455/269, 276.1, 277.1, 277.2

(56) References Cited

U.S. PATENT DOCUMENTS 4,719,469 A 1/1988 Beier et al.
5,194,873 A * 3/1993 Sickles, II ..... 342/374
5,248,981 A * 9/1993 Yoshihara et al. ..... 342/357.15
5,268,695 A * 12/1993 Dentinger et al. ..... 342/357.11
5,347,289 A 9/1994 Elhardt
5,592,174 A 1/1997 Nelson
6,633,258 B1 * 10/2003 Lindenmeier et al. ..... 342/374
2002/0058488 A1 * 5/2002 Miyahara ..... 455/277.2
2002/0193146 A1 * 12/2002 Wallace et al. ..... 455/562
2004/0030496 A1 * 2/2004 Brodie ..... 701/213

OTHER PUBLICATIONS

A.J. Van Dierendonck, et al., Eval. of GNSS Receiver Correlation Proc. Techniques for . . . , Proc. of the ION National Tech. Mtg. Santa Monica, CA, Jan. 14–16, 1997 pp. 207–215.

* cited by examiner

*Primary Examiner*—Dao Phan
(74) *Attorney, Agent, or Firm*—Jeffrey M. Weinick

(57) ABSTRACT

Disclosed is a method and apparatus for multipath mitigation using an antenna array. An antenna array made up of a plurality of antennas is used to receive satellite signals from satellites. Various configurations of antenna arrays is disclosed, including a linear vertical antenna array and a horizontal antenna array in which the antenna elements are located in a horizontal plane. A switch sequentially connects each of the antenna outputs to a single processing path to generate a common additive signal. The common additive signal is provided to satellite channel processors, each of which processes the signals from an associated satellite. A phase shift correction signal associated with each of the antennas is generated and synchronously applied to a carrier phase reference signal. A blocking signal may be applied to the satellite channel processors in order to block the processing of signals from an unwanted satellite.

26 Claims, 3 Drawing Sheets

METHOD AND APPARATUS FOR MULTIPATH MITIGATION USING ANTENNA ARRAY

BACKGROUND OF THE INVENTION

This invention relates generally to satellite navigation receivers and more particularly to multipath mitigation in a satellite navigation receiver.

Satellite navigation systems, such as GPS (USA) and GLONASS (Russia), are well known in the art and are intended for highly accurate self-positioning of users possessing special navigation receivers. A navigation receiver receives and processes radio signals transmitted by satellites located within line-of-sight distance of the receivers. The satellite signals comprise carrier signals that are modulated by pseudo-random binary codes. The receiver measures the time delay of the received signal relative to a local reference clock or oscillator. These measurements enable the receiver to determine the so-called pseudo-ranges between the receiver and the satellites. The pseudo-ranges are different from the ranges (distances) between the receiver and the satellites due to various noise sources and variations in the time scales of the satellites and receiver. If the number of satellites is large enough, then the measured pseudo-ranges can be processed to determine the user location and coordinate time scales.

The requirement of accurately determining user location with a high degree of precision, and the desire to improve the stability and reliability of measurements, have led to the development of differential navigation (DN). In differential navigation, the task of finding the user position, also called the Rover, is performed relative to a Base station (Base). The precise coordinates of the Base station are known and the Base station is generally stationary during measurements. The Base station has a navigation receiver which receives and processes the signals of the satellites to generate measurements. These signal measurements are transmitted to the Rover via a communication channel (e.g., wireless). The Rover uses these measurements received from the Base, along with its own measurements taken with its own navigation receiver, in order to precisely determine its location. The location determination is improved in the differential navigation mode because the Rover is able to use the Base station measurements in order to compensate for the major part of the strongly correlated errors in the Rover measurements.

Various modes of operation are possible while using differential navigation. In post-processing (PP) mode, the Rover's coordinates are determined by co-processing the Base and Rover measurements after all measurements have been completed. This allows for highly accurate location determination because more data is available for the location determination. In real-time processing (RTP) mode, the Rover's coordinates are determined in real time upon receipt of the Base station information received via the communication channel.

The location determination accuracy of differential navigation may be further improved by supplementing the pseudo-range measurements with measurements of the phases of the satellite carrier signals. If the carrier phase of the signal received from a satellite in the Base receiver is measured and compared to the carrier phase of the same satellite measured in the Rover receiver, measurement accuracy may be obtained to within several percent of the carrier's wavelength. The practical implementation of those advantages, which might otherwise be guaranteed by the measurement of the carrier phases, runs into the problem of ambiguity resolution for phase measurements.

The ambiguities are caused by two factors. First, the difference of distances from any satellite to the Base and Rover is usually much greater than the carrier's wavelength. Therefore, the difference in the phase delays of a carrier signal received by the Base and Rover receivers may substantially exceed one cycle. Second, it is not possible to measure the integer number of cycles from the incoming satellite signals; one can only measure the fractional part. Therefore, it is necessary to determine the integer number of cycles, which is called the "ambiguity". More precisely, we need to determine the set of all such integer parts for all the satellites being tracked, one integer part for each satellite. One has to determine this set along with other unknown values, which include the Rover's coordinates and the variations in the time scales.

At a high level, the task of generating highly-accurate navigation measurements is formulated as follows: it is necessary to determine the state vector of a system, with the vector containing $n_{\Sigma}$unknown components. Those include three Rover coordinates (usually along Cartesian axes X, Y, Z) in a given coordinate system (sometimes time derivatives of coordinates are added too); the variations of the time scales which is caused by the phase drift of the local main reference oscillator in the receiver; and n integer unknown values associated with the ambiguities of the phase measurements of the carrier frequencies. The value of n is determined by the number of different carrier signals being processed, and accordingly coincides with the number of satellite channels actively functioning in the receiver. At least one satellite channel is used for each satellite whose broadcast signals are being received and processed by the receiver. Some satellites broadcast more than one code-modulated carrier signal, such as a GPS satellite which broadcasts a carrier in the $L_1$ frequency band and a carrier in the $L_2$ frequency band. If the receiver processes the carrier signals in both of the $L_1$ and $L_2$ bands, a so-called dual-frequency receiver, the number of satellite channels (n) increases correspondingly. Dual-frequency receivers allow for ionosphere delay correction therefore making ambiguity resolution easier.

Two sets of navigation parameters are measured by the Base and Rover receivers, respectively, and are used to determine the unknown state vector. Each set of parameters includes the pseudo-range of each satellite to the receiver, and the full (complete) phase of each satellite carrier signal. Each pseudo-range is obtained by measuring the time delay of a code modulation signal of the corresponding satellite. The code modulation signal is tracked by a delay-lock loop (DLL) circuit in each satellite tracking channel. The full phase of a satellite's carrier signal is tracked by a phase-lock-loop (PLL) in the corresponding satellite tracking channel. An observation vector is generated as the collection of the measured navigation parameters for specific (definite) moments of time.

The relationship between the state vector and the observation vector is defined by a well-known system of navigation equations. Given an observation vector, the system of equations may be solved to find the state vector if the number of equations equals or exceeds the number of unknowns in the state vector. Conventional statistical methods are used to solve the system of equations: the least squares method, the method of dynamic Kalman filtering, and various modifications of these methods.

Practical implementations of these methods in digital form may vary widely. In implementing or developing such a method on a processor, one usually must find a compromise between the accuracy of the results and speed of obtaining results for a given amount of processor capability, while not exceeding a certain amount of loading on the processor.

One general scheme comprises the following steps. The measured values of the pseudo-ranges and full phases at specific (definite) moments of time, along with an indication of the satellites to which these measurements belong and the time moments of the measurements, are transmitted from the Base to the Rover. Corresponding values are measured in the Rover receiver. The processing includes the determination of the single differences of the pseudo-ranges and full phases between the Base and Rover measurements for each satellite. The strongly correlated errors are compensated (i.e., substantially cancelled) in the single differences. Then, the residuals of the single differences are calculated by subtraction of calculated values from the measured results. The processing of residuals allows one to linearize the initial system of navigation equations (sometimes several subsequent iterations are necessary), which makes possible the use of the well developed body of mathematics for solving systems of linear equations. The components of the state vector, with the n ambiguities included, are found as a result of the solution. But the calculated values of the ambiguities are not necessarily integer numbers, and are often floating point numbers. Because of this, they are called float ambiguities, or floating ambiguities, at this stage of the solution. To find true values of the integer ambiguities one uses the procedure of rounding off the float ambiguity vector to the nearest set of integers. This process is called the ambiguity resolution. Only after the ambiguity resolution has been done is it possible to determine the true values of residuals and then, by solving the system of equations again, to find the coordinate values for the baseline connecting the Base and Rover, and consequently to determine the exact coordinates of the Rover and the correction to its clock drift.

The above described general scheme of computations is well known in the art and is described in further detail, for example, in, Bradford W. Parkinson and James J. Spilker Jr., *Global Positioning Theory and Applications*, Volume 163 of Progress In Astronautics and Aeronautics, published by the American Institute of Aeronautics and Astronautics, Inc, Washington D.C., 1996, which is incorporated herein by reference.

One of the problems with satellite navigation receivers is that satellite signals are difficult to detect in certain circumstances. Various environmental influences and interference signals cause measurement errors. One of the major sources of error in satellite navigation receivers is multipath error. Multipath error is caused by satellite signals reflecting off various surfaces (e.g., buildings). These reflected signals arrive at the receiver later than the direct line-of-sight signal, as the reflected signals travel via a longer path to the satellite receiver. If these multipath signals are tracked in the satellite receiver, positioning errors will occur. Another characteristic of the multipath signals is that the multipath signals are generally received from a direction different from the line-of-sight signal.

Various techniques have been employed to reduce the effect of multipath signals. One technique is to use special processing methods in order to detect and remove the multipath signals from the navigation computation. These techniques generally rely on the fact that multipath signals are delayed in time as compared to the direct line-of-sight signals. For example, A. J. Van Dierendonck, M. S. Braasch, *Evaluation of GNSS Receiver Correlation Processing Techniques for Multipath and Noise Mitigation*, Proceedings of the Institute of Navigation National Technical Meeting, Santa Monica, Calif., Jan. 14–16, 1997, pp. 207–215, describes techniques for multipath mitigation at the digital signal processing stage. These techniques are based on different modifications of correlation convolution for the received and reference signals. The focus of the described methods is to change the shape of the reference signal so that multipath errors at certain delays of the reflected signal would be minimal. One problem with multipath mitigation using this technique is energy loss (i.e., reduction in signal-to-noise ratio) and the inability to suppress multipath errors caused by reflected signals with delay less than 10 . . . 30 m with respect to the direct signal.

Other techniques for reducing the effect of multipath signals are directed to antenna design. These techniques rely on the fact that multipath signals generally arrive at the antenna from a direction different from the line-of-sight signals. These antenna techniques generally are based on designing the antenna gain pattern to counter the reflected multipath signals. These multipath signals are attenuated by the antenna's insensitivity to signals coming from the unwanted direction.

Another antenna technique for reducing multipath error is the use of controllable antenna arrays (e.g., phased antenna arrays) in which multiple antenna elements are connected to independent receiver channels. Through appropriate signal processing, the directional response of a phased antenna array may be electronically altered. While phased antenna arrays may be useful in reducing multipath signals, one problem with phased antenna arrays is the computational complexity required in the receiver. Such receivers generally require a powerful processor to process the signals from the multiple antenna elements, have high power consumption, and have relatively large physical dimensions.

BRIEF SUMMARY OF THE INVENTION

In accordance with one embodiment of the invention, an antenna array made up of a plurality of antennas is used to receive satellite signals from a plurality of satellites. A switch connects each of the antenna outputs to a single processing path. The switch is operative to sequentially connect an output of each of the antennas to the single processing path thereby generating a common additive signal. This signal has components associated with each of the antennas. The signal also contains the signals of the various satellites. The common additive signal is provided to each of a plurality of satellite channel processors, each of which processes the signals from an associated one of the satellites.

A phase shift correction module generates a plurality of phase shift correction signals, each associated with one of the antennas. This phase shift correction signal is provided to the satellite channel processors, where the phase shift correction signal is synchronously applied to a carrier phase reference signal. The phase shift correction signal is synchronously applied in that the phase shift correction signal associated with a particular antenna is applied to the carrier phase reference signal at the same time that the signal from the particular antenna is being processed by the satellite channel processor. The phase shift correction signal is calculated based on various information regarding the configuration of the antenna array and the relationship of the antenna array to the satellite.

In accordance with a particular embodiment, a blocking signal may be applied to the satellite channel processors in order to block the processing of signals from an unwanted satellite. In a vertical antenna array embodiment, such unwanted satellite may be a satellite located above a threshold elevation angle relative to the antenna array.

These and other advantages of the invention will be apparent to those of ordinary skill in the art by reference to the following detailed description and the accompanying drawings.

DETAILED DESCRIPTION

The principles of the present invention may be implemented in connection with various types of satellite navigation receivers. For example, in a differential navigation system, the principles of the present invention may be applied to a Rover satellite receivers or a Base satellite receiver.

Figure 1:
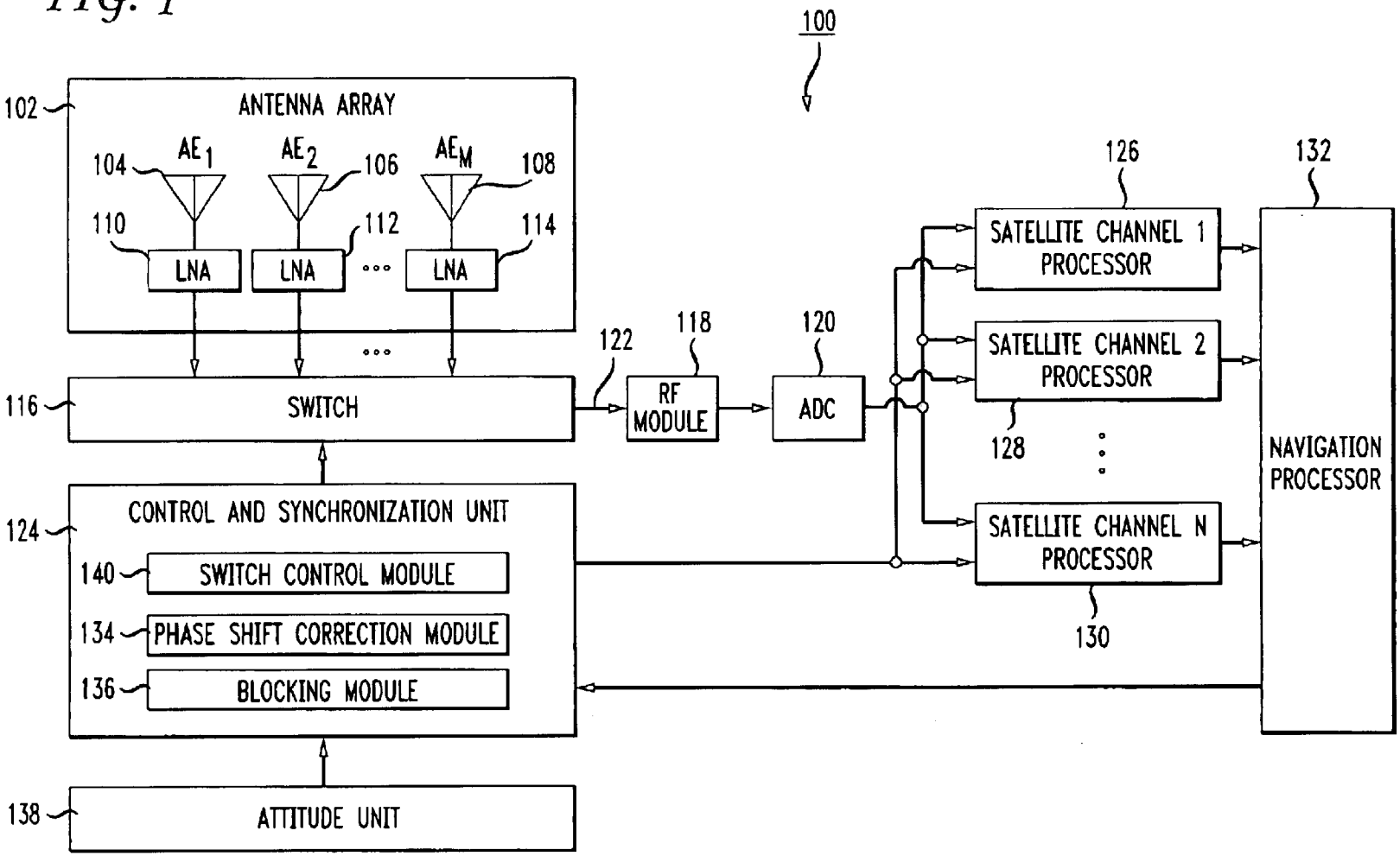
FIG. 1 shows a high level block diagram of a satellite receiver in accordance with one embodiment of the invention.

FIG. 1 shows a high level block diagram of a satellite receiver 100 in accordance with one embodiment of the invention. It is noted that the block diagrams used herein are meant to describe the high level functioning and configuration of a unit. One skilled in the art would readily recognize that some of the blocks represent hardware components while other blocks represent some function or operation. The functions and operations may be performed by hardware circuits, software instructions executing on a processor, firmware, or some combination of hardware and software. Given the description herein, those skilled in the art would be able to implement the described functionality using well known and various combinations of hardware and software. As such, implementation details of the functions described herein will not be described in detail as such implementation details would be readily known to one skilled in the art.

Satellite receiver 100 comprises an antenna array 102 containing m antenna elements (AE) $AE_1$ 104, $AE_2$ 106, . . . $AE_m$ 108. Various well known antenna elements may be used to implement the antenna array 102. For example, the antenna elements of the antenna array may be implemented using the MGA-2 antenna of Topcon America Corporation.

The geometry of the antenna array 102 is described using a geocentric (i.e., earth-centered) coordinate system with the origin of the coordinate system deemed to be the antenna center. The coordinate system is chosen to allow computation of the difference of distances between each of the phased array antenna elements and a satellite. Such a computation is necessary to calculate the phase shifts of the phased array at a specific geometric/mathematical point, a so-called phase center of the antenna array.

Each antenna element 104, 106, . . . 108 receives signals from navigation satellites. The phase and amplitude of the signals received by each of the antenna elements depends upon the spatial attitude of the antenna element and upon the gain pattern of the antenna element.

Figure 2:
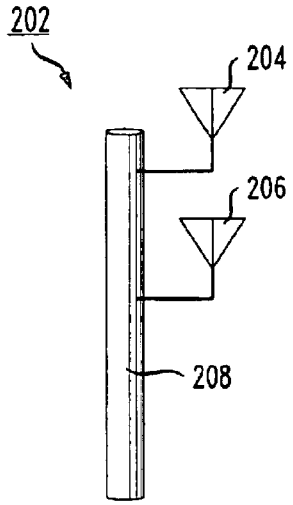
FIG. 2 shows a linear vertical antenna array.

Different antenna array configurations are useful for different implementation environments. For example, in open areas where ground reflections are responsible for most of the multipath signals, a linear vertical antenna array, as shown in FIG. 2, is useful. The antenna array 202 of FIG. 2 comprises antenna element 204 and antenna element 206 which are mounted coaxial on rod 208. The vertical array of FIG. 2 is useful in mitigating multipath reflections from the ground or other underlying surfaces, which reflections are most typical with respect to satellites at low elevation angles (e.g., lower than 30 degrees). The processing of signals in accordance with a vertical coaxial antenna array embodiment will be described in further detail below.

Figure 3:
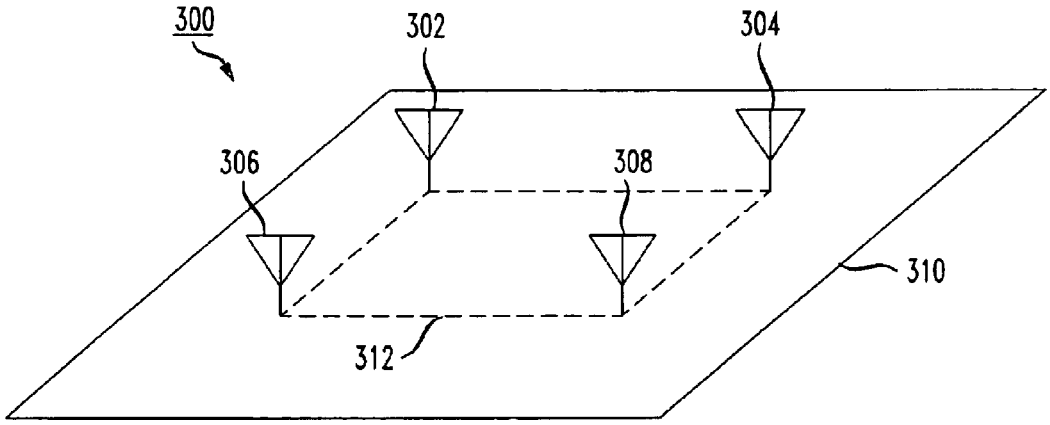
FIG. 3 shows a horizontal antenna array in which the antenna elements are located in a horizontal plane.

In an environment in which reflected signals are received from various directions and from higher elevation angles, a horizontal planar antenna array is useful in mitigating the multipath signals. FIG. 3 shows a horizontal antenna array in which antenna elements 302, 304, 306, 308 are located in a horizontal plane 310. The elements may be separated and configured in mutually orthogonal directions. For example, as shown in FIG. 3, the four antenna elements 302, 304, 306, 308 are located in the corners of a square 312. A horizontal planar antenna array as shown in FIG. 3 is useful, for example, in urban conditions where reflections from buildings are the common source of multipath reflected signals. The processing of signals in accordance with a horizontal planar antenna array embodiment will be described in further detail below.

Returning now to FIG. 1, the antenna elements 104, 106, . . . 108 are connected to low noise amplifiers (LNA) 110, 112, . . . 114 respectively. The LNAs amplify the signals from the outputs of the antenna elements. The LNAs 110, 112, 114 are connected to switch 116 and the amplified signals from the LNAs are provided to the switch 116. The switch 116 sequentially and cyclically connects each of the antenna outputs (via LNAs) to RF module 118 via an RF-cable 122. Thus, switch 116 provides for the generation of a common additive signal to the single signal processing path. In the particular embodiment of FIG. 1, the signal processing path starts with RF-cable 122. The switching order and frequency of the switch 116 is controlled by a switch control module 140 of a control and synchronization unit 124. The frequency of switch 116 (i.e., the frequency of switching the antenna elements to the processing path) is dependent upon the number of antenna elements in the antenna array and on the bandwidth of the phase locked loop (PLL) (described in further detail below). The switching frequency of the switch 116 should be greater than the PLL bandwidth. For example, in an embodiment in which the antenna array is implemented as a horizontal planar antenna array with four antenna elements (e.g., as shown in FIG. 3), if the PLL bandwidth is in the range 20 . . . 25 Hz, then a switching frequency of approximately 1 kHz is acceptable. As will be discussed in further detail below, in such an embodiment, the PLL is an inertial system taking into account the time interval during which there exists successive switching to the elements of the antenna array. Such lag effect (inertia) enables the system to provide smoothing (i.e., averaging) for the jumps in multipath errors occurring in the different antenna elements.

RF cable 122 provides the common additive signal to RF module 118. RF module 118 amplifies, frequency converts, and filters the common additive signal in a manner well known in the art. The signal output from the RF module 118 has low carrier frequency and sufficient power for analog to digital conversion. It is noted that for multi-system (e.g., GPS and GLONASS) receivers and multi-band (e.g., L1 and L2) receivers, the RF module 118 performs its functions with respect to the signals of each system and each band in a particular satellite channel.

The output of the RF module 118 is provided to an analog-to-digital converter (ADC) 120, where the signal in each satellite channel is quantized by level and digitized by time. In accordance with various embodiments, the ADC 120 may utilizes various levels of quantization. For example, the ADC 120 may use two or three level quantization. The ADC 120 provides the digital common additive signal to individual satellite channel processors.

Each of the satellite channels (1 . . . N) has a satellite channel processor shown in FIG. 1 as 126, 128, 130. Each of the satellite channel processors receives the common additive signal from ADC 120 and processes its associated portion of the common additive signal as will be described in further detail below. The output of the satellite channel processors is provided to a navigation processor 132 which performs the navigation task in a well known manner. The navigation processor 132 also provides information back to the control and synchronization unit 124 as will be described in further detail below.

Figure 4:
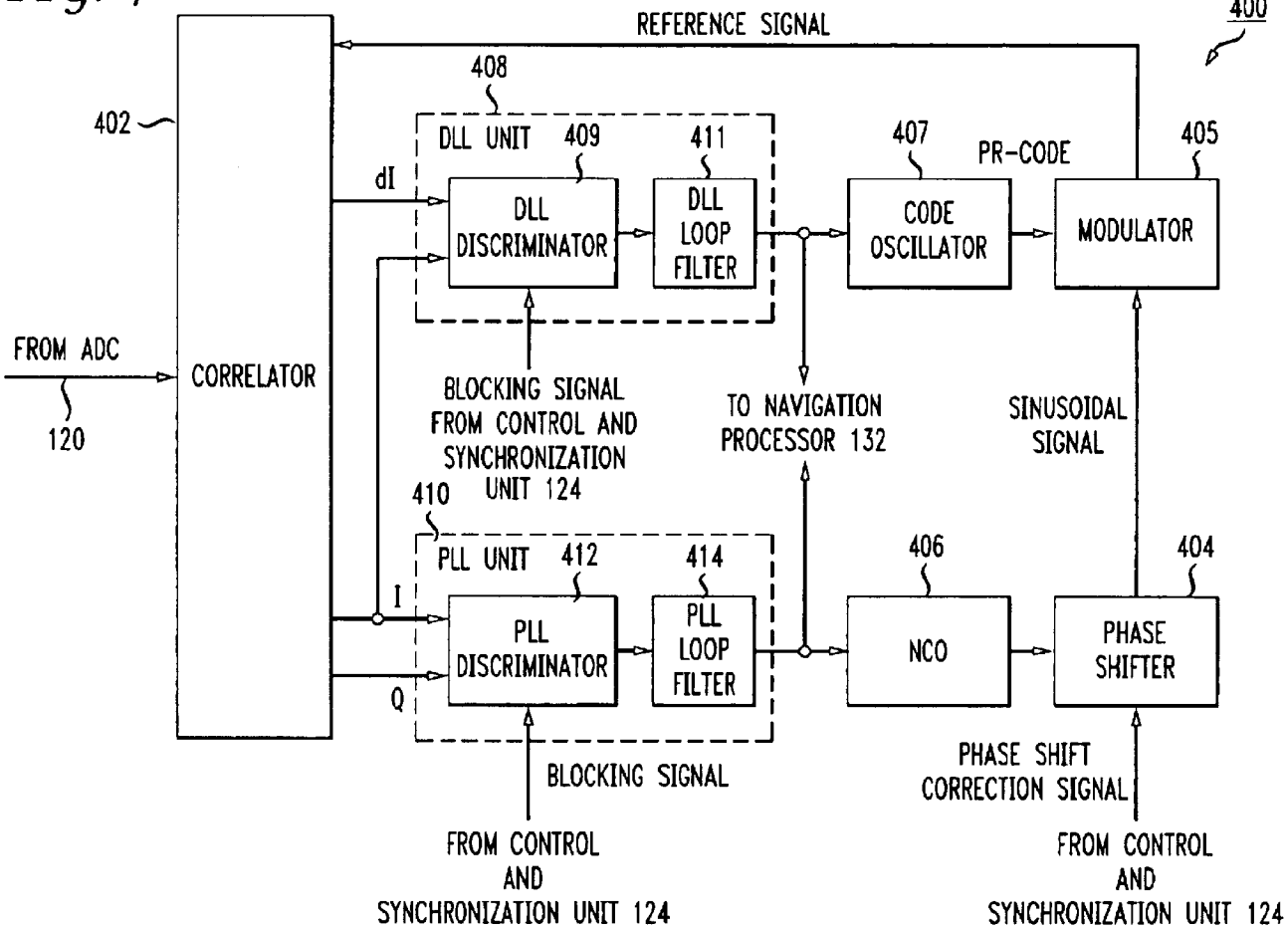
FIG. 4 shows a block diagram of a satellite channel processor.

FIG. 4 shows further details of a satellite channel processor 400. The satellite channel processor 400 comprises a correlator 402. The correlator 402 receives as an input the common additive signal from the ADC 120 and correlates the samples of the satellite channel signal (of the satellite being processed by the particular satellite channel processor) with the samples of a reference signal received from modulator 405. The generation of the reference signal will be described in further detail below.

The correlator 402 produces values dl, I, Q, where dl is the in-phase correlation signal of the delay lock loop (DLL), I is the in-phase correlation signal, and Q is the quadrature correlation signal. These values are generated as a result of multiplying the input signal from the ADC 120 with the reference signal in a manner well known in the art. The correlator 402 provides dl to the delay lock loop (DLL) unit 408 and I, Q to the phase lock loop (PLL) unit 410. The PLL unit 410 tracks the carrier phase signal and the DLL unit 408 tracks the pseudo-random code signal. By integrating the controlling signals output from the PLL unit 410 and the DLL unit 408, carrier phase and pseudo-ranges are generated. In addition, ephemeris data, which is necessary to compute satellite coordinates, is formed, during the process of demodulating binary symbols of the satellite signal. The carrier phase, pseudo-ranges and ephemeris data may be used by the navigation processor 132 in a well known manner in order to perform the navigation task.

The DLL 408 is a tracking system which tracks the time delay of the pseudo-random code of the reference signal compared to the pseudo-random code of the received signal. The DLL discriminator 409 may operate to generate Z=dl/I. The DLL loop filter 411 may have the following transfer function: K(p)=K1+K2/p, where K1 and K2 are the coefficients of the proportional and integrating filter loops respectively, and p=jw, j=sqrt(−1), w=2πf, and f is the frequency. The coefficients are-selected so that the bandwidth of the filter would be 0.5 . . . 0.2 Hz.

The PLL unit 410 operates as follows. Samples I and Q from the output of the correlator 402 are provided to the PLL discriminator 412. The PLL discriminator 412 may operate to generate Z=atan (Q/I). The output of the PLL discriminator 412 is provided to the PLL loop filter 414. The PLL loop filter 414 may have the following transfer function: K(p)=K1+K2/p+K3/(p*p) where K1, K2 and K3 are the coefficients of the proportional, integrating and double integrating filter loops respectively, and p jw, j=sqrt(−1), w=2πf, and f is the frequency. The coefficients are selected so that the bandwidth of the filter would be 10 . . . 0.50 Hz.

The controlling signal output by the PLL loop filter 414 in addition to being provided to the navigation processor 132 for the navigation task, is further provided to a carrier numerical controlled oscillator (NCO) 406, which generates the appropriate frequency of the carrier reference signal for the satellite channel being processed by the satellite channel processor 400. This frequency will be different for each of the satellite channel processors shown in FIG. 1 because each satellite channel processor tracks one specific satellite in view of the antenna array 102. The signals from the output of the PLL loop filter 414 contain the information about the difference in the carrier phase of the received and reference signals. This difference is continuously applied to the NCO 406 in order to correct the NCO and provide phase and frequency coincidence between the reference signal oscillations and carrier signal oscillations.

The code oscillator 407 generates the appropriate pseudo-random code. The pseudo-random code is selected according to the GPS satellite number (in case of GLONASS the channel frequency number of the reference signal is used) being processed by the particular satellite channel processor 400 in a manner well known to one of ordinary skill in the art.

The phase shifter 404 adds the phase of NCO 406 to a phase shift correction signal received from the control and synchronization unit 124 as will be described in further detail below. The output of the phase shifter 404 is then provided to the modulator 405 which modulates the sinusoidal signal output from the phase shifter 404 with the pseudo-random code output from the code oscillator 407 to generate the reference signal.

As described above, the phase shifter 404 adds the phase of the signal output by the NCO 406 to a correction phase shift signal generated by the phase shift correction module 134 of the control and synchronization unit 124. The phase shift correction module 134 generates the correction phase shift signal as follows.

In an embodiment in which the antenna array 102 is implemented as a horizontal planar antenna array, phase shift correction module 134 generates a correction phase shift signal ($\phi_{ik}$) for the i-th antenna element and the k-th satellite in accordance with the following equation:

$$\phi_{ik}=(2\pi L_i/\lambda)(\cos\theta_k\theta_i\cos(\alpha_k-\alpha_i)+\sin\theta_k\sin\theta_i) \quad [1]$$

where $\lambda$ is the wavelength of the carrier oscillation;

$L_i$ is the distance between the i-th antenna element and the antenna center;

$\theta_i$ is the elevation angle of a line that connects the antenna center to the i-th element;

$\theta_k$ is the elevation angle of the k-th satellite;

$\alpha_i$ is the azimuth of the line that connects the antenna center to the i-th element; and $\alpha_k$ is the azimuth of the k-th satellite.

The input parameters related to the satellite coordinates ($\theta_k$, $\alpha_k$) are provided to the control and synchronization unit 124 from the navigation processor 132. The input parameters related to the tilt and bend angles of the antenna array ($\theta_i$, $\alpha_i$) are provided to the control and synchronization unit 124 from an attitude unit 138. If the antenna array is stationary, these angles may be manually entered into the attitude unit 138 by a user or they may be obtained by geodetic measurements. If the antenna array is not stationary, then these angles may be determined by tilt and bend/swing sensors with frequency correspondent to the antenna dynamics. In one embodiment, a digital magnetic compass, for example the HMR3000 available from Honeywell, may be used to implement these sensors. The input parameters related to the angles of the antenna elements and the element-to-element distance are known in advance based on the design of the antenna array and may be stored in the attitude unit 138 in advance.

In an embodiment in which the antenna array 102 is implemented as a linear vertical antenna array with the antenna center on the vertical rod, the phase shift correction module 134 generates a correction phase shift signal ($\phi_{ik}$) for the i-th antenna element and the k-th satellite in accordance with the following equation:

$$\phi_{ik}=(2\pi L_i/\lambda)\sin\theta_k$$

where $L_i$, $\lambda$, and $\theta_k$ are as described above.

Further, in a linear vertical antenna array embodiment (e.g., as shown in FIG. 2), it is desirable to block the signals from the bottom antenna element 206 with respect to signals received from satellites having high elevation angles because at high elevation angles the upper antenna 204 shades the bottom antenna, thereby resulting in a deterioration of the signal received at the bottom antenna 206. In this embodiment, the blocking module 136 of the control and synchronization unit 124 generates a blocking signal at the moment when the antenna switch 116 connects the bottom element of the vertical antenna array to the signal processing path, and this blocking signal is provided to the PLL unit 410 and DLL unit 408 of each of the satellite channel processors, thereby disabling the signal from the bottom antenna in the PLL unit 410 and DLL unit 408. The particular satellite elevation angle, above which the bottom antenna element will be blocked, is dependent upon the particular design of the vertical antenna array. In an advantageous embodiment, a suitable threshold angle is 30 . . . 45 degrees.

The operation frequency of the control and synchronization unit 124 is synchronized with the PLL bandwidth. For example, in an embodiment in which the antenna array is implemented as a horizontal planar antenna array with four antenna elements (e.g., as shown in FIG. 3), if the PLL bandwidth is between 20 . . . 25 Hz, then the operation period of the control and synchronization unit is equal to 0.8 ms. As described above, the control and synchronization unit 124 controls switch 116 to cyclically connect antenna elements $AE_1$ 104, $AE_2$ 106. $AE_m$ 108 to RF cable 122 and the single signal processing path. Simultaneously, the phase shift correction module 134 of the control and synchronization unit 124 generates the phase shift correction signal which is output to the phase shifter 404. The phase shift correction signal is synchronously generated for the particular antenna element of the antenna array that is currently connected to the signaling path. Thus, for example, at the moment when the signal from antenna element $AE_1$ 104 is connected to the single signal processing path, and is being processed by the satellite channel processors, the phase shift correction signal generated for $AE_1$ 104 is provided to the phase shifter 404 of each of the satellite channel processors 400.

Having described various embodiments of the invention above, a higher level more theoretical discussion of processing in accordance with the embodiments will now be given. The above described embodiments suggests that only satellite signals received by the antenna array elements directly from a satellite, be phased. A correction phase shift is calculated for each antenna array element and each active satellite based on information about the direction to the satellite, the angle attitude of the antenna array, and the configuration of elements in the antenna array. The calculated correction phase shift is added to the PLL reference signal. A common additive signal, which comprises signals of the successively switched antenna elements, arrives at the input of a processing channel for each satellite. The common additive signal contains the direct signal and an interference component including constituents of both noise and reflected (multipath) signals. Both of the interference constituents contribute to the total error budget, although their influence differs. The components of interference signal have different spectra, even though they are both additive and pass through the common signal path.

Noise is a wide-band process with short correlation time. Hence, noise samples are substantially independent if the phase shift between them is equal to the clock of the antenna switch (where the clock is the time period which is inverse to the switching frequency) both in a signal of a one-element antenna and in the additive signal of a switchable antenna array. If the antenna elements are the same, then the variance of the noise samples and spectral density of the noise component are the same as well. The direct signal may be regarded as a process that can be characterized by slowly alternating parameters such that an inertial PLL, which is part of the processing path of the antenna, tracks the phase with negligible error. As to a phased array with switchable antenna elements, the phase of the direct signal, being part of the additive signal, changes with each clock of the antenna switch, because the antenna elements are separated in space. However, such changes are compensated in the PLL reference signal with the help of the RF module. Hence, strength of the direct signal component occurring In the PLL circuit is the same for both a one-element antenna and a switchable antenna array. Since the PLL is an inertial system whose pass band/bandwidth is substantially less than the switching frequency of the antenna switch, noise (phase) error is determined as the ratio of the power of noise components over PLL bandwidth to the effective power of the direct signal component and thus is the same for both the one-element and the switchable antenna array.

The parameters of the reflected signal also change slowly and are well tracked by the inertial PLL. Hence, for the phase of the one-element antenna multipath error is defined by the ratio of the direct signal strength to the reflected signal strength. The component of the reflected signal which is included in the additive signal tends to have phase jumps (unlike the direct signal) that are not compensated in the reference signal by the phase changers, because phase shifts between antenna elements for direct and reflected signals differ in value. The left phase jumps that follow with switching frequency widen the spectrum of the reflected component but do not affect its power. This results in reducing power of the PLL bandwidth (only part of the power remains) and thus in decreasing the multipath error.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention.

What is claimed is:

1. A method comprising the steps of:

receiving a plurality of satellite signals at a plurality of antennas;

sequentially and cyclically switching an output of each of said plurality of antennas to a single signal processing path to generate a common additive signal;

providing said common additive signal to each of a plurality of satellite channel processors; and processing signals from each of said plurality of satellites in a respective one of said plurality of satellite channel processors.

2. The method of claim 1 wherein said step of processing signals from each of said plurality of satellites in a respective one of said plurality of said satellite channel processors further comprises, in each of said satellite channel processors, the step of:

tracking a carrier phase of a satellite signal using a reference signal.

3. The method of claim 2 further comprising the step of:

generating a plurality of phase shift correction signals, each of said phase shift correction signals associated with one of said antennas; and wherein said step of processing signals from each of said plurality of satellites in a respective one of said plurality of satellite channel processors further comprises, in each of said satellite channel processors, the step of synchronously applying the phase shift correction signal associated with a particular antenna to the reference signal during processing of the component of the satellite signal associated with said particular antenna.

4. The method of claim 3 wherein said antennas are implemented as a horizontal antenna array and wherein said phase shift correction signals $\phi_{ik}$ for an i-th antenna and a k-th satellite are calculated according to:

$$\phi_{ik}=(2\pi L_i/\lambda)(\cos\theta_k\theta_i\cos(\alpha_k-\alpha_i)+\sin\theta_k\sin\theta_i)$$

where $\lambda$ is the wavelength of carrier oscillation;

Li is the distance between the i-th antenna and an antenna center;

θi is the elevation angle of a line that connects the antenna center to the i-th antenna;

θk is the elevation angle of the k-th satellite;

αi is the azimuth of a line that connects the antenna center to the i-th element; and αk is the azimuth of the k-th satellite.

5. The method of claim 3 wherein said antennas are implemented as a vertical antenna array with an antenna center on the vertical axis and wherein said phase shift correction signals $\phi_{ik}$ for an i-th antenna and a k-th satellite are calculated according to:

$$\phi_{ik}=(2L_i/\lambda)\sin\theta_k$$

where

λis the wavelength of carrier oscillation;

$L_i$ is the distance between the i-th antenna and an antenna center; and $\theta_k$ is the elevation angle of the k-th satellite.

6. The method of claim 1 wherein said step of processing signals from each of said plurality of satellites in a respective one of said plurality of satellite channel processors further comprises, in each of said satellite channel processors, the step of:

tracking a pseudo-random code of a satellite signal using a delay locked loop circuit.

7. The method of claim 1 wherein said step of processing signals from each of said plurality of satellites in a respective one of said plurality of satellite channel processors further comprises, in each of said satellite channel processors, the steps of:

tracking a carrier phase of a satellite signal using a phase locked loop circuit; and tracking a pseudo-random code of a satellite signal using a delay locked loop circuit.

8. The method of claim 1 further comprising the step of applying a blocking signal to said plurality of satellite channel processors to block the processing of signals from an unwanted satellite.

9. The method of claim 8 wherein said plurality of antennas are arranged as a vertical antenna array and wherein said unwanted satellite is located above a threshold elevation angle relative to said antenna array.

10. An apparatus comprising:

a plurality of antennas;

a switch connected to said plurality of antennas for sequentially and cyclically switching an output of each of said plurality of antennas to a single signal processing path and thereby producing a common additive signal on said single signal processing path; and a plurality of satellite channel processors each having an input connected to said signal path for receiving said common additive signal and each for processing signals from a respective one of said satellites.

11. The apparatus of claim 10 wherein each of said plurality of satellite channel processors comprises:

a phase locked loop circuit for tracking a carrier phase of a satellite signal using a reference signal.

12. The apparatus of claim 11 further comprising a phase shift correction module for generating a plurality of phase shift correction signals, each of said phase shift correction signals associated with one of said antennas.

13. The apparatus of claim 12 wherein each of said plurality of satellite channel processors further comprises a phase shifter for receiving said phase shift correction signals and for applying said phase shift correction signals to said reference signal.

14. The apparatus of claim 12 wherein said antennas are implemented as a horizontal antenna array and wherein said phase shift correction signals $\phi_{ik}$ for an i-th antenna and a k-th satellite are calculated according to:

$$\phi_{ik}=(2\pi L_i/\lambda)(\cos\theta_k\theta_i\cos(\alpha_k-\alpha_i)+\sin\theta_k\sin\theta_i)$$

where $\lambda$ is the wavelength of carrier oscillation;

$L_i$ is the distance between the i-th antenna and an antenna center;

$\theta_i$ is the elevation angle of a line that connects the antenna center to the i-th antenna;

$\theta_k$ is the elevation angle of the k-th satellite;

$\theta_i$ is the azimuth of a line that connects the antenna center to the i-th element; and $\theta_k$ is the azimuth of the k-th satellite.

15. The apparatus of claim 12 wherein said antennas are implemented as a vertical antenna array with an antenna center on the vertical axis and wherein said phase shift correction signals $\phi_{ik}$ for an i-th antenna and a k-th satellite are calculated according to:

$$\phi_{ik}(2\pi L_i\lambda)\sin\theta_k$$

where $\lambda$ is the wavelength of carrier oscillation;

$L_i$ is the distance between the i-th antenna and an antenna center; and $\theta_k$ is the elevation angle of the k-th satellite.

16. The apparatus of claim 10 further comprising a blocking module for generating a blocking signal and providing said blocking signal to said plurality of satellite channel processors to block the processing of signals from an unwanted satellite.

17. The apparatus of claim 16 wherein said plurality of antennas are arranged as a vertical antenna array and wherein said unwanted satellite is located above a threshold elevation angle relative to said antenna array.

18. An apparatus comprising:

a plurality of antennas for receiving a plurality of satellite signals;

means for sequentially and cyclically switching an output of each of said plurality of antennas to a single signal processing path to generate a common additive signal;

means for providing said common additive signal to each of a plurality of satellite channel processors; and a plurality of satellite channel processors, each for processing signals from a respective one of said plurality of satellites.

19. The apparatus of claim 18 wherein each of said satellite channel processors further comprises:

means for tracking a carrier phase of a satellite signal using a reference signal.

20. The apparatus of claim 19 further comprising:

means for generating a plurality of phase shift correction signals, each of said phase shift correction signals associated with one of said antennas; and wherein each of said satellite channel processors further comprises means for synchronously applying the phase shift correction signal associated with a particular antenna to the reference signal during processing of the component of the satellite signal associated with said particular antenna.

21. The apparatus of claim 20 wherein said antennas are implemented as a horizontal antenna array and wherein said means for generating a plurality of phase shift correction signals $\phi_{ik}$ for an i-th antenna and a k-th satellite calculates said phase shift correction signals according to:

$$\phi_{ik}=(2\pi L_i/\lambda)(\cos\theta_k\theta_i\cos(\alpha_k-\alpha_i)+\sin\theta_k\sin\theta_i)$$

where $\lambda$ is the wavelength of carrier oscillation;

$L_i$ is the distance between the i-th antenna and an antenna center;

$\theta_i$ is the elevation angle of a line that connects the antenna center to the i-th antenna;

$\theta_k$ is the elevation angle of the k-th satellite;

$\alpha_i$ is the azimuth of a line that connects the antenna center to the i-th element; and $\alpha_k$ is the azimuth of the k-th satellite.

22. The apparatus of claim 20 wherein said antennas are implemented as a vertical antenna array with an antenna center on the vertical axis and wherein said means for generating a plurality of phase shift correction signals $\phi_{ik}$ for an i-th antenna and a k-th satellite calculates said phase shift correction signals according to:

$$\phi_{ik}=(2\pi L_i/\lambda)\sin\theta_k$$

where $\lambda$ is the wavelength of carrier oscillation;

$L_i$ is the distance between the i-th antenna and an antenna center; and $\theta_k$ is the elevation angle of the k-th satellite.

23. The apparatus of claim 18 wherein each of said satellite channel processors further comprises:

means for tracking a pseudo-random code of a satellite signal using a delay locked loop circuit.

24. The apparatus of claim 18 wherein each of said satellite channel processors further comprises:

means for tracking a carrier phase of a satellite signal using a phase locked loop circuit; and means for tracking a pseudo-random code of a satellite signal using a delay locked loop circuit.

25. The apparatus of claim 18 further comprising:

means for of applying a blocking signal to said plurality of satellite channel processors to block the processing of signals from an unwanted satellite.

26. The apparatus of claim 25 wherein said plurality of antennas are arranged as a vertical antenna array and wherein said unwanted satellite is located above a threshold elevation angle relative to said antenna array.

* * * * *

UNITED STATES PATENT AND TRADEMARK OFFICE

CERTIFICATE OF CORRECTION

PATENT NO. : 6,882,312 B1
DATED : April 19, 2005
INVENTOR(S) : Michael Yu et al.

It is certified that error appears in the above-identified patent and that said Letters Patent is hereby corrected as shown below:

Column 7,
Line 65, "p jw", should read -- p=jw --.

Column 9,
Line 45, "$AE_2$ 106. $AE_m$ 108", should read -- $AE_2$ 106 … $AE_m$ 108 --.

Column 12,
Line 66, the equation in claim 15 should read -- $\varphi_{ik} = (2\,\pi L_i / \lambda) \sin \theta_k$ --.

Signed and Sealed this

Nineteenth Day of July, 2005

JON W. DUDAS
*Director of the United States Patent and Trademark Office*